US008999901B2

(12) United States Patent
Lyon et al.

(10) Patent No.: US 8,999,901 B2
(45) **Date of Patent: *Apr. 7, 2015**

(54) LUBRICANT BASE STOCKS WITH IMPROVED FILTERABILITY

(71) Applicant: ExxonMobil Research and Engineering Company, Annandale, NJ (US)

(72) Inventors: Kristen Amanda Lyon, West Deptford, NJ (US); Charles L. Baker, Jr., Thornton, PA (US); Serge Riffard, Saint Nom la Breteche (FR)

(73) Assignee: ExxonMobil Research and Engineering Company, Annandale, NJ (US)

( * ) Notice: Subject to any disclaimer, the term of this patent is extended or adjusted under 35 U.S.C. 154(b) by 42 days.

This patent is subject to a terminal disclaimer.

(21) Appl. No.: 13/796,548

(22) Filed: Mar. 12, 2013

(65) Prior Publication Data

US 2014/0274827 A1 Sep. 18, 2014

(51) Int. Cl.

| | |
|---|---|
| ***C10M 169/04*** | (2006.01) |
| ***C10G 71/00*** | (2006.01) |
| ***C10G 73/02*** | (2006.01) |
| ***C10G 73/32*** | (2006.01) |
| ***C10M 101/02*** | (2006.01) |

(52) U.S. Cl.

CPC ..... *C10M 101/02* (2013.01); *C10M 2203/1006* (2013.01); *C10M 2203/1085* (2013.01); *C10N 2220/022* (2013.01); *C10N 2230/02* (2013.01)

(58) Field of Classification Search

USPC ..... 508/110; 208/18, 28, 38

See application file for complete search history.

(56) References Cited

U.S. PATENT DOCUMENTS

| | | | | |
|---|---|---|---|---|
| 6,495,495 | B1 | 12/2002 | Alger et al. | |
| 7,776,206 | B2 | 8/2010 | Miller et al. | |
| 2004/0094453 | A1 * | 5/2004 | Lok et al. | 208/19 |
| 2006/0019841 | A1 | 1/2006 | Clague | |
| 2008/0153723 | A1 | 6/2008 | Boons et al. | |
| 2011/0083995 | A1 * | 4/2011 | Gleeson et al. | 208/38 |

FOREIGN PATENT DOCUMENTS

EP 2298855 A1 3/2011

OTHER PUBLICATIONS

The International Search Report and Written Opinion of PCT/US2014/017086 dated Apr. 22, 2014.

* cited by examiner

*Primary Examiner* — Vishal Vasisth
(74) *Attorney, Agent, or Firm* — Robert A. Migliorini

(57) ABSTRACT

Provided for are lubricant base stocks with improved filterability. The lubricant base stock includes a bright stock and an effective amount of a heavy neutral. The filterability of the base stock as measured by the Membrane Filtration Method is less than or equal to 400 seconds. Also provided for are lubricating oils with improved filterability and methods of improving the filterability of lubricant base stocks.

16 Claims, 3 Drawing Sheets

LUBRICANT BASE STOCKS WITH IMPROVED FILTERABILITY

FIELD

The present invention relates to the field of lubricant base stocks. It more particularly relates to lubricant base stocks with improved filterability. Still more particularly, the present disclosure relates to lubricant base stocks including bright stock with a heavy neutral as an additive for improved filterability.

BACKGROUND

Lubricant base stocks are commonly used for the production of lubricants, such as lubricating oils for automotives, industrial lubricants and lubricating greases. A base oil is defined as a combination of two or more base stocks used to make a lubricant composition. They are also used as process oils, white oils, metal working oils and heat transfer fluids. Finished lubricants consist of two general components, lubricating base stock and additives. Lubricating base stock is the major constituent in these finished lubricants and contributes significantly to the properties of the finished lubricant. In general, a few lubricating base stocks are used to manufacture a wide variety of finished lubricants by varying the mixtures of individual lubricating base stocks and individual additives.

According to the American Petroleum institute (API) classifications, base stocks are categorized in five groups based on their saturated hydrocarbon content, sulfur level, and viscosity index (Table 1). Lube base stocks are typically produced in large scale from non-renewable petroleum sources. Group I, II, and III base stocks are all derived from crude oil via extensive processing, such as solvent extraction, solvent or catalytic dewaxing, and hydroisomerization. Group III base stocks can also be produced from synthetic hydrocarbon liquids obtained from natural gas, coal or other fossil resources. Group IV base stocks, the polyalphaolefins (PAO), are produced by oligomerization of alpha olefins, such as 1-decene. Group V base stocks include everything that does not belong to Groups I-IV, such as naphthenics, polyalkylene glycols (PAG), and esters.

TABLE 1

| API classification | Group I | Group II | Group III | Group IV | Group V |
|---|---|---|---|---|---|
| % Saturates | <90 | ≥90 | ≥90 | Polyalpha-olefins (PAO) | All others not belonging to group I-IV |
| % S | >0.03 | ≤0.03 | ≤0.03 | | |
| Viscosity Index (VI) | 80-120 | 80-120 | ≥120 | | |

The automotive industry has been using lubricants and thus base stocks with improved technical properties for a long time. Increasingly, the specifications for finished lubricants require products with excellent low temperature properties, high oxidation stability, low filterability and low volatility. Generally lubricating base stocks are base stocks having kinematic viscosity of about 3 cSt or greater at 100° C. (Kv100); pour point (PP) of about −12° C. or less; and viscosity index (VI) about 90 or greater. In general, high performance lubricating base stocks should have a Noack volatility no greater than current conventional Group I or Group II light neutral oils. Currently, only a small fraction of the base stocks manufactured today are able to meet these demanding specifications.

U.S. Patent Publication No. 2006/0019841 A1 discloses the use of a $C_{12-20}$ polyalkyl methacrylate polymer as a lubricating oil additive such that the $C_{12-20}$ polyalkyl methacrylate polymer accounts for 0.1 to 0.3% by weight of the finished lubricating oil. The use comprises the addition of said $C_{12-20}$ polyalkyl methacrylate polymer to a lubricating oil based on mineral oil to improve the filtration of said lubricating oil based on mineral oil.

Group I base stocks may be further broken down based on kinematic viscosity range at 100 deg. C. into light neutral (LN), heavy neutral (HN) and bright stock (BS). Light neutral has a kinematic viscosity in the range of 4-6 cSt, heavy neutral (HN) has a kinematic viscosity in the range of 10-12 cSt, and bright stock has a kinematic viscosity in the range of 30-34 cSt. Due to its high viscosity, bright stock is used in many industrial oil applications. In many of these applications, cleanliness of the lubricating oil is an important property because the oil may pass through fine orifices and filters. The lubricating oil needs to have acceptable filterability to keep fine orifices and filters from plugging up during operation. Bright stock is produced commercially with a wide range of filterabilities. Bright stock presents challenges for filterability because of its relatively high viscosity. In addition, filterability becomes more of an issue as bright stock is produced from more challenged crudes.

Hence, there is a need to improve the filterability of bright stock to increase the range of crude oils that it may be produced from and the lubricating oil applications that it may be used in.

SUMMARY

According to the present disclosure, an advantageous lubricant base stock comprises a bright stock and an effective amount of a heavy neutral, wherein the filterability of the base stock as measured by the Membrane Filtration Method is less than or equal to 400 seconds.

A further aspect of the present disclosure relates to an advantageous lubricating oil comprising a lubricant base stock and an effective amount of one or more lubricant additives, wherein the base stock includes a bright stock and an effective amount of a heavy neutral, wherein the filterability of the base stock as measured by the Membrane Filtration Method is less than or equal to 400 seconds.

Another aspect of the present disclosure relates to an advantageous method of improving the filterability of a lubricant base stock comprising providing a bright stock and a heavy neutral, and adding an effective amount of the heavy neutral to the bright stock, wherein the filterability of the base stock as measured by the Membrane Filtration Method is less than or equal to 400 seconds.

These and other features and attributes of the disclosed lubricant base stocks, lubricating oils and methods of improving filterability of the present disclosure and their advantageous applications and/or uses will be apparent from the detailed description which follows, particularly when read in conjunction with the figures appended hereto.

BRIEF DESCRIPTION OF DRAWINGS

To assist those of ordinary skill in the relevant art in making and using the subject matter hereof, reference is made to the appended drawings, wherein.

DETAILED DESCRIPTION

Figure 1:
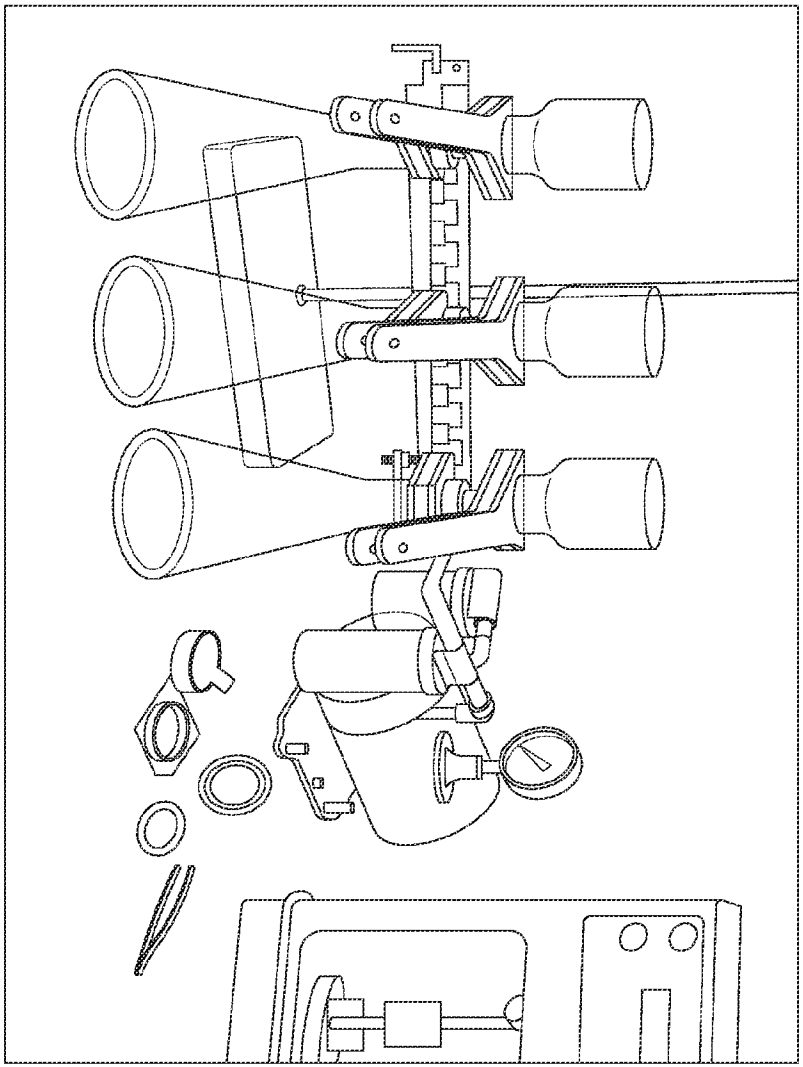
FIG. 1 is a black and white photo of the membrane filtration apparatus used in the Membrane Filtration Method for determining sediment and filterability of industrial oils (ExxonMobil Analytical Test Method 1082-01).

All numerical values within the detailed description and the claims herein are modified by "about" or "approximately" the indicated value, and take into account experimental error and variations that would be expected by a person having ordinary skill in the art.

Overview

The present disclosure provides novel lubricant base stocks with improved filterability. The Applicants have unexpectedly and surprisingly discovered that when a small amount of heavy neutral (HN) Group I base stock is added bright stock, there is step change improvement in filterability. This permits bright stock to be used in a broader range of filterability requiring lubricant formulations.

Refineries do not manufacture a single lube base stock but rather process several distillate fractions and a vacuum residuum fraction. Generally, at least three distillate fractions differing in boiling range and the residuum may be refined. These four fractions have acquired various names in the refining art, the most volatile distillate fraction often being referred to as the "light neutral" fraction or oil. The other distillates are called "intermediate neutral" and "heavy neutral" oils. The vacuum residuum, after deasphalting, solvent extraction and dewaxing, is commonly referred to as "bright stock." Thus, the manufacture of lubricant base stocks involves a process for producing a slate of base stocks, which slate includes at least one refined distillate and one bright stock. Additionally, each subtractive step produces a byproduct which may be processed further or sold to an industry which has developed a use for the byproduct.

The starting point for producing mineral oil lubricants is in the atmospheric or vacuum distillation tower. Distillation separates the crude oil into different components by their boiling range. The lubricant boiling range fraction, which boils above about 650 degree. F, makes the charge stock for lubricant refining. The components of the lubricant charge stock include paraffins, naphthenes, aromatics, resins and asphaltenes. The paraffinic and naphthenic distillate fractions are generally referred to as the neutrals, e.g. heavy neutral and light neutral. Although the heavy neutral is characterized by a higher percentage of naphthenes and the light neutral is characterized by a higher percentage paraffins, both contain some aromatics along with some paraffins and naphthenes. Because the aromatic components lead to high viscosity and extremely poor viscosity indices, highly aromatic asphaltic type crudes are not the preferred feedstocks. The resins and alphaltenes are undesirable because they are too viscous and contain high levels of metals and sulfur. The paraffinic and naphthenic crude stocks are preferred yet their lubricant qualities conflict. The more paraffinic stocks make good lubricants because they possess excellent viscosity properties, yet the long straight chain paraffinic component encourages an undesirably high pour point. On the other hand, the naphthenic stocks have the desirable low pour point but have poor viscosity properties.

Bright stock constitutes a bottoms fraction which has been highly refined and dewaxed. Bright stock is a high viscosity base oil. Conventional petroleum derived bright stock is named for the SUS viscosity at 210 degrees F., having viscosities above 180 cSt at 40 degrees C., preferably above 250 cSt at 40 degrees C., and more preferably ranging from 500 to 1100 cSt at 40 degrees C. Alternatively, bright stock has a kinematic viscosity in the range of 30-34 cSt at 100 degrees C. Bright stock may be an API Group I or Group II base stock depending on its properties. U.S. Pat. No. 7,776,206 entitled "Production of High Quality Lubricant Bright Stock" discloses a process for producing bright stock from a heavy feed petroleum crude, and is herein incorporated by reference in its entirety. Group I heavy neutral base stock heavy neutral (HN) has a kinematic viscosity in the range of 10-12 cSt.

Lubricant Base Stock Embodiments

In one embodiment, disclosed is a lubricant base stock including a bright stock that incurs a step change improvement in filterability as measured by the Membrane Filtration Method for determining sediment and filterability of industrial oils (ExxonMobil Analytical Test Method 1082-01) when an effective amount of a heavy neutral is added to the lubricant base stock. An effective amount of a Group I heavy neutral is defined as ranging from 0.5 to 50 wt. % of the base stock, or from 0.75 to 20 wt. % of the base stock, or from 1.0 to 20 wt. % of the base stock. At these levels of heavy neutral in the bright stock, the filterability of the base stock as measured by the Membrane Filtration Method is less than or equal to 400 seconds, or less than or equal to 300 seconds, or less than or equal to 200 seconds. The Applicants have also discovered that the filterability of the bright stock including the effective amount of heavy neutral is particularly stable when stored at room temperature. That is, the filterability increases less than 200 seconds over a time frame of 4-weeks when stored at room temperature, or less than 150 seconds over a time frame of 4-weeks when stored at room temperature, or less than 100 seconds over a time frame of 4-weeks when stored at room temperature, or less than 50 seconds over a time frame of 4-weeks when stored at room temperature.

After blending the heavy neutral into the bright stock, the base stock may have a kinematic viscosity at 100° C. ranging from 10 to 40 cSt, or from 10 to 34 cSt, or from 10 to 30 cSt, or from 10 to 20 cSt, or from 10 to 18 cSt, or from 10 to 12 cSt.

Method of Improving Filterability Embodiments

In another embodiment, disclosed is a method of improving the filterability of a lubricant base stock for bright stock by incorporating into the base stock an effective amount of heavy neutral. The filterability as measured by the Membrane Filtration Method for determining sediment and filterability of industrial oils (ExxonMobil Analytical Test Method 1082-01) is significantly reduced compared to a bright stock that does not include the HN. An effective amount of a Group I heavy neutral is defined as ranging from 0.5 to 50 wt. % of the base stock, or from 0.75 to 20 wt. % of the base stock, or from 1.0 to 20 wt.% of the base stock. At these levels of the heavy neutral in the bright stock, the filterability of the base stock as measured by the Membrane Filtration Method is less than or equal to 400 seconds, or less than or equal to 300 seconds, or less than or equal to 200 seconds. The Applicants have also discovered that the filterability of the bright stock including the effective amount of HN is particularly stable when stored at room temperature. That is, the filterability increases less than 200 seconds over a time frame of 4-weeks when stored at room temperature, or less than 150 seconds over a time frame of 4-weeks when stored at room temperature, or less than 100 seconds over a time frame of 4-weeks when stored at room temperature, or less than 50 seconds over a time frame of 4-weeks when stored at room temperature.

Lubricating Oil Embodiments

In yet another embodiment, disclosed is a lubricating oil including a lubricant base stock and lubricant additives that also incurs a step change improvement in filterability as measured by the Membrane Filtration Method for determining sediment and filterability of industrial oils (ExxonMobil Analytical Test Method 1082-01) when a bright stock with an effective amount of a heavy neutral is added to the lubricating oil. Hence, the benefits in filterability obtained in the bright stock and HN combination are retained when other additives as added to make a lubricating oil. An effective amount of a heavy neutral in the lubricating oil is defined as ranging from 0.5 to 50 wt. % of the base stock, or from 0.75 to 20 wt. % of the base stock, or from 1.0 to 20 wt. % of the base stock. At these levels of the heavy neutral in the bright stock, the filterability of the base stock as measured by the Membrane Filtration Method is less than or equal to 400 seconds, or less than or equal to 300 seconds, or less than or equal to 200 seconds. The Applicants have also discovered that the filterability of the bright stock including the effective amount of HN is particularly stable when stored at room temperature. That is, the filterability increases less than 200 seconds over a time frame of 4-weeks when stored at room temperature, or less than 150 seconds over a time frame of 4-weeks when stored at room temperature, or less than 100 seconds over a time frame of 4-weeks when stored at room temperature, or less than 50 seconds over a time frame of 4-weeks when stored at room temperature.

The one or more lubricant additives that may be added to the lubricating oil may include, but is not limited to, antioxidants, stabilizers, detergents, dispersants, demulsifiers, antioxidants, anti-wear additives, viscosity index modifiers, pour point depressants, friction modifiers, anti-foam additives, defoaming agents, corrosion inhibitors, wetting agents, rust inhibitors, copper passivators, metal deactivators, extreme pressure additives, and combinations thereof. The effective amount of the one or more lubricant additives in the lubricating oil is defined as ranging from 0.2 to 20 wt. % of the lubricating oil, or from 0.4 to 18 wt. % of the lubricating oil, or from 1.0 to 15 wt. % of the lubricating oil, or from 2.0 to 10 wt. % of the lubricating oil, or from 4.0 to 8 wt. % of the lubricating oil.

The lube base stocks with improved filterability of the present disclosure can optionally be blended with other lube base stocks to form lubricants. Useful co-base lube stocks include Group II, III, IV and V base stocks and gas-to-liquid (GTL) oils. One or more of the co-base stocks may be blended into a lubricant composition including the lube base stock with improved filterability at from 0.1 to 50 wt. %, or 0.5 to 40 wt. %, 1 to 35 wt. %, or 2 to 30 wt. %, or 5 to 25 wt. %, or 10 to 20 wt. %, based on the total lubricant composition.

Lubricants including lube base stocks with improved filterability of the present disclosure may optionally include lube base stock additives, such as detergents, dispersants, antioxidants, anti-wear additives, viscosity index modifiers, pour point depressants, friction modifiers, de-foaming agents, corrosion inhibitors, wetting agents, rust inhibitors, and the like. The additives are incorporated with the lube base stocks of the present disclosure to make a finished lubricant that has desired viscosity and physical properties. Typical additives used in lubricant formulation can be found in the book "Lubricant Additives, Chemistry and Applications", Ed. L. R. Rudnick, Marcel Dekker, Inc, 270 Madison Ave. New York, NJ 10016, 2003.

When lubricating oil compositions contain one or more of the additives discussed above, the additive(s) are blended into the composition in an amount effective for it to perform its intended function. Typical amounts of such additives useful in the present invention are shown in Table 1 below. The total of the additional additives in the lubricating oil composition may range from 0.1 to 50 wt. %., or 0.5 to 40 wt. %, 1 to 35 wt. %, or 1 to 20 wt. % of the composition, or 2 to 18 wt. %, or 3 to 15 wt. %, or 4 to 10 wt. %, or 5 to 8 wt. %. Note that many of the additives are shipped from the manufacturer and used with a certain amount of base stock solvent in the formulation. Accordingly, the weight amounts in the table below, as well as other amounts mentioned in this patent, unless otherwise indicated are directed to the amount of active ingredient (that is the non-solvent portion of the ingredient).

The wt. % indicated below are based on the total weight of t bricating oil composition.

TABLE 1

Typical Amounts of Various Lubricant Oil Components

| Compound | Approximate wt % (useful) | Approximate wt % (preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Antioxidant | 0.0-5 | 0.0-1.5 |
| Corrosion Inhibitor | 0.01-5 | 0.01-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base stock or base stocks | Balance | Balance |

Method of Use Lubricants With Improved Filterability

The lube base stocks with improved filterability and lubricating oils may be employed in the present disclosure in a variety of lubricant-related end uses, such as a lubricant oil or grease for a device or apparatus requiring lubrication of moving and/or interacting mechanical parts, components, or surfaces. Useful apparatuses include engines and machines. The lubricating oils with improved filterability of the present disclosure are most suitable for use in the formulation of automotive crank case lubricants, automotive gear oils, transmission oils, many industrial lubricants including circulation lubricant, industrial gear lubricants, grease, compressor oil, pump oils, refrigeration lubricants, hydraulic lubricants, metal working fluids.

Test Methods

The determination of filterability performance of the lubricant base stocks was determined by the Membrane Filtration Method for determining sediment and filterability of industrial oils. This is ExxonMobil Analytical Test Method 1082-01. This internal test method was adopted in 1971; and revised in 1974, 1976, 1985, 1993, 1998, and 2001. The test method is as follows:

1. Introduction 1.1 This revision includes updating various procedural steps.

2. Scope 2.1 This method is used primarily (a) to determine insoluble contaminants (sediments) suspended in hydraulic oils (DTE), way lubricants (Vactra numbered) and circulating oils (paper machine oils), and (b) to measure the filterability of hydraulic oils. The test is intended for control of oil cleanliness to quality specifications. It can be used to measure the cleanliness and filterability of other products, e.g., circulating oils, turbine oils, etc., and also base stocks, 2.2 Mobil Method M1386, "Filtration time of Mobil Vactra Numbered Oils," is used to determine the filterability of way lubricants.

2.3 This standard may involve hazardous materials, operations, and equipment. This standard does not purport to address all of the safety problems associated with its use. It is the responsibility of whoever uses this standard to consult and establish appropriate safety and health practices and determine the applicability of regulatory limitations prior to use.

3. Definition 3.1 Filterability is the time required for a specified volume of sample, neat or diluted, to pass through a micropore filter membrane under standard conditions of dilution, pore size, filter diameter, vacuum, etc.

4. Outline of Method 4.1 A measured volume of sample is diluted with solvent and filtered through a membrane of specified porosity. The amount of sediment that is retained is determined from the increase in weight of membrane. The filterability is determined by measuring the filtration time.

5. Apparatus 5.1 Filtration Equipment. The following items are available from the Millipore Filter Corporation, Bedford, Mass., or from other suppliers of Millipore materials:

5.1.1 Filter Holder, Pyrex, consisting of a 300-ml funnel, clamp, and stainless steel disc support. Cat. No. XX-10-047-30.

5.1.2 Forceps, stainless steel.

5.1.3 Membrane Filters, plain, white, 47-mm diameter.

0.3 micron, Cat. No, PH-W-P-047-00.

0.8 micron, Cat, No. AA-W-P-047-00.

5.0 micron, Cat. No. SM-W-P-047-00.

Assemble the apparatus as shown in FIG. 1, using either a 500-ml or one-liter suction flask.

Note 1

Prepare the suction flask by rinsing several times with n-pentane.

5.2 Drying Oven, explosion-proof, capable of maintaining a temperature of 75±2° C. Available from most laboratory supply companies.

5.3 Vacuum Source, capable of maintaining constant vacuum of 125 mm and 250 mm of mercury (gauge vacuum). The vacuum may be measured with a vacuum meter. If a regulated laboratory vacuum source is not available, a suitable pump may be purchased from the Millipore Corporation: Cat. No. XX-55-000-00, or Fisher Scientific Co., 191 South Gulph Road, King of Prussia, Pa. 19406; Cat. No. 1-093-5.

5.4 Weighing Dishes, aluminum. Available from Fisher Scientific Co,; Cat. No. 8-732.

5.5 Stopwatch.

5.6 Separatory Funnel, 500-ml, with Teflon plug.

5.7 Wash Bottle, 500-ml.

6. Reagents and Materials 6.1 All chemicals are reagent grade unless specified otherwise, and all water used is distilled or deionized.

6.2 n-Pentane (Caution! See Appendix A.2.1), for hydraulic oils.

6.3 Sovasol No. 2, or Precipitation Naphtha (Caution! See Appendix A.2.2).

6.3.1 The solvent is filtered through a 0.3 micron filter.

7. Sample Preparation 7.1 Allow the sample to equilibrate to room temperature (24±3° C.) (Note 2). Prior to further handling, shake the container by hand for about 30 seconds to ensure that all sediment, if present, is uniformly distributed, Note 2

If wax is present, the time-temperature conditioning of the sample can affect the test results significantly. The presence of wax may not be apparent unless the sample is allowed to stand in a cool state (room temperature) long enough for the wax to crystallize. Samples, which are suspected to contain wax, e.g., hydraulic oils, should be held at room temperature for 24 hours, shaken by hand for about 30 seconds and then tested. See Note 6.

8. Procedure 8.1 Hydraulic Oils.

8.1.1 Place a 0.8-micron membrane in an aluminum weighing dish with the correct side up (Note 3) and dry for 10 minutes in an oven at 75±2° C. Remove the dish and cool for about 10 minutes in a dust-free area, such as a covered drying block. Remove the membrane from the dish, weigh to the nearest 0.1 mg, and record the weight as $W_1$. Place it correct side up on the stainless steel support, attach the funnel, and clamp together.

Note 3

The membrane must be placed on the stainless steel mesh filter support with the correct side up. Failure to do this may result in incorrect filter times. In most cases, the membranes as received are packed with the correct side facing up. In other cases, a written statement indicating the correct side is packed with the membranes. Handle the membranes with forceps to avoid disturbing the filtering surface or altering the weight.

8.1.2 Measure 100 ml of the sample with a graduated cylinder into a separatory funnel (Note 4, Note 5). Add two 25-ml portions of n-pentane and rinse the sides with it. Stopper the funnel and mix by shaking the mixture for about 30 seconds. Suspend the separatory funnel in such a manner that the bottom of the stem is approximately one inch above the filter membrane. Open the stopcock and introduce the mixture into the filter cup.

Note 4

If a funnel with a glass stopcock plug is used, lubricate the plug lightly with pure mineral oil.

Note 5

The use of a separatory funnel is convenient but not mandatory. However, if the oil solvent blend is mixed in a graduated cylinder (250-ml) and added directly to the filter, a constant level must be maintained in the filter cup.

8.1.3 Apply a gauge vacuum of 125 mm of mercury to the suction flask, and adjust the liquid flow from the separatory funnel to maintain a constant level in the filter cup.

8.1.4 Measure and record the elapsed time required to filter the 150 ml oil-pentane mixture as follows: Start the watch when the first drop appears through the apparatus. Stop the watch when all the solution has passed through the membrane, i.e., when the membrane first appears dry. Discontinue the test if the filtration is not complete within 30 minutes (Note 6). Record the elapsed time as "First 100-ml Filter Time."

Note 6

Although this modification is not usually requested, to determine if a high filtration time is caused by wax (Note 2), heat 250 ml of well-shaken sample to 50° C., cool to room temperature and allow to stand one hour. Shake 30 seconds and test in the usual way. If the filtration time is substantially less then the value obtained after the 24-hour conditioning, the presence of wax is likely. Report the filtration times determined by the two tests, i.e., after one-hour and 24-hour conditioning periods, and the sediment measured after one-hour conditioning.

8.1.5 If a second 100-ml filtering time is specified for the product, repeat Sections 8.1.2, 8.1.3, and 8.1.4, using the same membrane, graduated cylinder, and separatory funnel. Record the elapsed time as "Second 100-ml Filter Time."

8.1.6 Rinse the graduated cylinder with about 20 ml of n-pentane and transfer this to the separatory funnel (stopcock open) in such a manner as to rinse the wall. Repeat with two more 20-ml portions of n-pentane. When the filtration is complete, remove the separatory funnel and rinse the wall of the filter cup with about 40 ml of n-pentane from the wash bottle (Note 7). With the vacuum still applied, remove the filter cup and wash the membrane with about 40 ml of n-pentane from the wash bottle. Direct the stream from the periphery toward the center of the membrane.

Note 7

Care must be taken to ensure that all the oil is washed through.

8.1.7 Turn off the vacuum. Gently remove the membrane using forceps. Place it in the oven at 75° C. for 10 minutes; remove and cool in a dust-free area for 10 minutes. Weigh the membrane plus sediment to the nearest 0.1 mg and record as $W_2$.

8.2 Way Lubricants.

8.2.1 Place a 5.0-micron membrane in an aluminum weighing dish and proceed as described in Section 8.1.11.

8.2.2 Measure 75 ml of sample into the separatory funnel and add 25 ml of prefiltered Sovasol No. 2 or precipitation naphtha. Proceed as described in Section 8.1.2.

8.2.3 Apply a gauge vacuum of 250 mm of mercury to the suction flask. Proceed as directed in Sections 8.1.3, 8.1.6 and 8.1.7, but substituting Sovasol No. 2 for n-pentane.

8.3 Circulating Oils (Paper Machine Oils)

8.3.1 Place a 5.0 micron membrane in an aluminum weighing dish and proceed as described in Section 8.1.1.

8.3.2 Measure 100 ml of sample into the separatory funnel and add 50 ml of pentane or precipitation naphtha. Proceed as described in Section 8.1.2.

to 8.3.3 Apply a gauge vacuum of 125 mm of mercury to the suction flask. Proceed as directed in Sections 8.1.3, 8.1.6, and 8.1.7, 9. Calculation and Report 9.1 Hydraulic Oils (DTE).

9.1.1 Calculate and report the sediment retained on an 0.8-micron membrane as follows:

$$\text{Sediment, mg per 100 ml of oil} = \frac{100(W_2 - W_1)}{V}$$

where:

$W_1$=weight of membrane, mg $W_2$=weight of membrane plus sediment, mg

V=total volume of oil filtered, ml 9.1.2 Report the elapsed time under Section 8.1.4 as "First 100-ml Filtered Time" (Note 6).

9.1.3 Report the elapsed time under Section 8.1.5 as "Second 100-ml Filter Time" (Note 8).

Note 8

If the test was discontinued after 30 minutes because of plugging, report the Filter Time as 30+ minutes without reporting sediment weight.

9.2 Way Lubricants (Vactra numbered).

9.2.1 Calculate and report the sediment retained on a 5.0-micron membrane as follows:

$$\text{Sediment, mg per 75 ml of oil} = W_2 - W_1$$

9.3 Circulating Oils (PMO)

9.3.1 Calculate and report the sediment retained on an 5.0 micron membrane as follows:

$$\text{Sediment, mg per 100 ml of oil} = \frac{100(W_2 - W_1)}{V}$$

where:

$W_1$=weight of membrane, mg $W_2$=weight of membrane plus sediment, mg

V=total volume of oil filtered, ml 9.3.2 Report the elapsed time under Section 8.1.4 as "First 100 ml Filtered Time" (Note 6).

The following are examples of the present disclosure and are not to be construed as limiting.

EXAMPLES

Illustrative Example 1

Impact of Heavy Neutral at Various Treat Rates in Bright Stock

Figure 2:
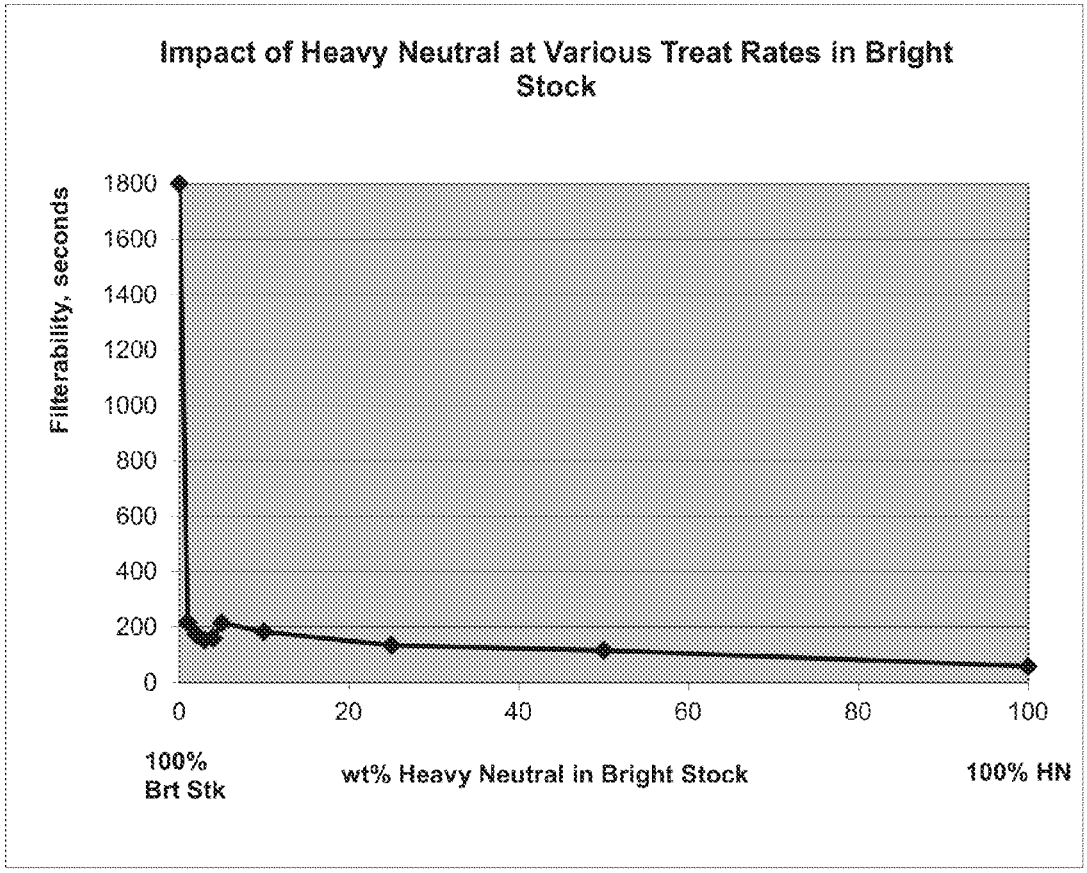
FIG. 2 is a graph showing the impact on filterability of heavy neutral as an additive in bright stock at various treat rates.

In this Example, blends of bright stock and Group I heavy neutral were made at HN treat rates or loadings ranging from 1.0 wt.% to 50 wt. %. The bright stock/HN blends along with the bright stock with no HN (control or comparative example) and the Group I HN were then tested for 5 micron filterability using the procedure detailed in the Test Methods section. The bright stock with no HN had a 5 micron filterability of greater than 1800 seconds and the HN had a filterability of 59 seconds. FIG. 2 is a graph showing the impact on filterability of various loadings (1.0 to 50 wt. %) of HN in the bright stock. As can be seen in FIG. 2, at low treat rates of the HN (1, 2, 3, 4 and 5 wt. %), the filterability of the bright stock blends decreased to about 218 seconds or less, which is a significant improvement relative to the bright stock with no HN (>1800 seconds). Hence a small addition of HN to the bright stock resulted in an unexpected step change improvement in filterability.

Illustrative Example 2

Impact of Timing on Filterability in Bright Stock

Figure 3:
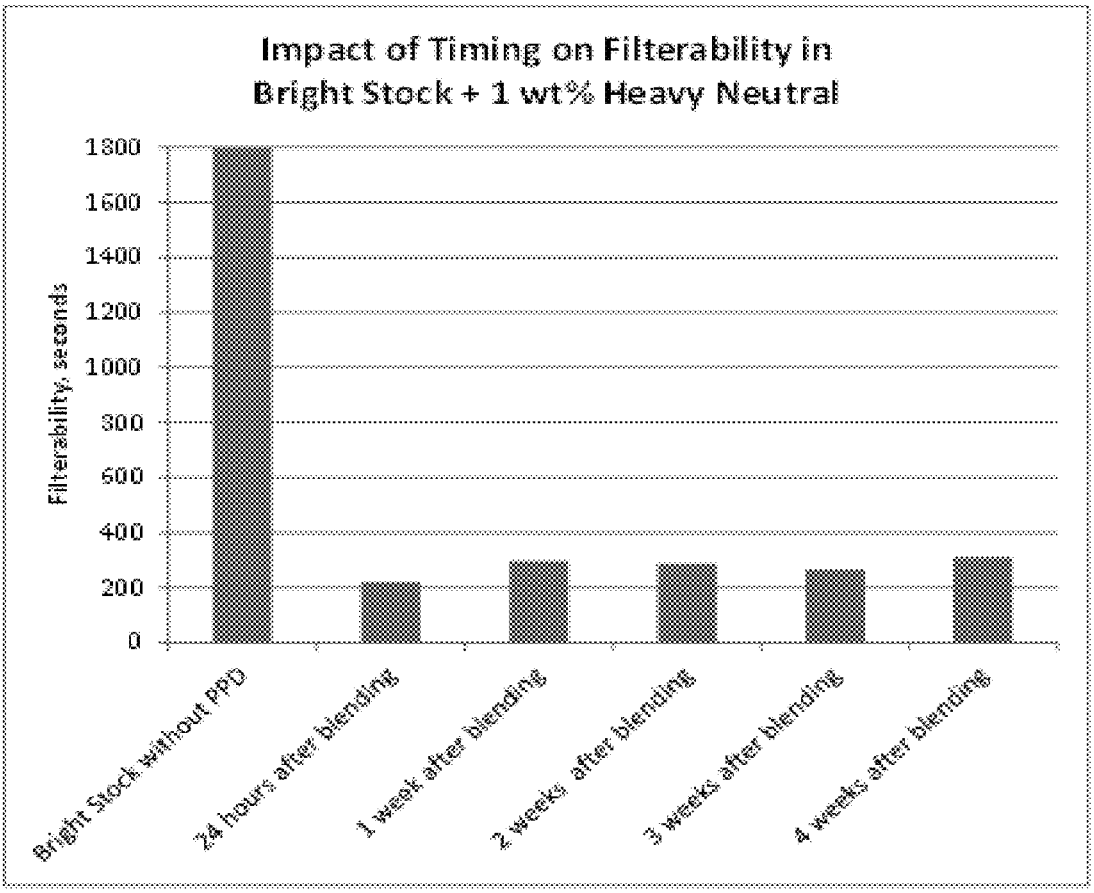
FIG. 3 is a bar graph showing the impact of timing on the filterability in a bright stock and 1 wt. % heavy neutral blend.

In this example, blends of bright stock and 1 wt. % heavy neutral were prepared. The bright stock/HN blends were then tested for filterability using the procedure detailed in the Test Methods section at various times after blending to determine the impact of time after blending on filterability performance. This was to determine the stability of the blends incorporating the HN with regard to filterability performance. The times after blending prior to filterability testing were 24 hours, 1-week, 2-weeks, 3-weeks and 4-weeks. The blends were stored at room temperature for the time periods. Also tested for filterability was bright stock with no HN (control or comparative example) of known poor filterability performance as measured in the EM membrane filtration test. The bright stock with no HN had a filterability of greater than 1800 seconds. FIG. 3 is a bar graph showing the impact on time after blending on filterability filterability performance. As can be seen in FIG. 3, at a treat rate of 1 wt. % using the heavy neutral, the filterability of the bright stock/HN blends is less than or equal to 310 seconds for blend aging times of 24 hours to 4 weeks. The filterability went up less than 100 seconds for an aging time of 4 weeks. Hence a small addition of HN to the bright stock resulted in not only an unexpected step change improvement in filterability, but also in the blends being stable as a function of time with regard to filterability performance. Table 2 below has the data that is included in FIG. 3.

TABLE 2

Impact of Timing on Filterability in Bright Stock + 1 wt % Heavy Neutral

| | Test Time after Blending | Filterability, seconds |
|---|---|---|
| Bright Stock, no PPD | — | >1800 |
| Bright Stock + Heavy Neutral | 24 hours | 221 |
| Bright Stock + Heavy Neutral | 1 week | 297 |
| Bright Stock + Heavy Neutral | 2 weeks | 287 |
| Bright Stock + Heavy Neutral | 3 weeks | 265 |
| Bright Stock + Heavy Neutral | 4 weeks | 310 |

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated.

What is claimed is:

1. A lubricant base stock comprising a bright stock and 0.5 to 5 wt. % of a heavy neutral, wherein the filterability of the base stock as measured by the Membrane Filtration Method is less than or equal to 400 seconds.

2. The base stock of claim 1, wherein the heavy neutral ranges from 1 to 3 wt. % of the base stock.

3. The base stock of claim 1, wherein the filterability of the base stock as measured by the Membrane Filtration Method is less than or equal to 300 seconds.

4. The base stock of claim 1, wherein the filterability of the base stock as measured by the Membrane Filtration Method is less than or equal to 200 seconds.

5. The base stock of claim 1, wherein the base stock has a kinematic viscosity at 100° C. ranging from 20 to 40 cSt.

6. The base stock of claim 1, wherein the heavy neutral has a kinematic viscosity at ranging from 10-12 cSt.

7. The base stock of claim 1, wherein the filterability increases less than 200 seconds over a time frame of 4-weeks when stored at room temperature.

8. The base stock of claim 7, wherein the filterability increases less than 100 seconds over a time frame of 4-weeks when stored at room temperature.

9. A lubricating oil comprising a lubricant base stock and an effective amount of one or more lubricant additives, wherein the base stock includes a bright stock and 0.5 to 5 wt. % of a heavy neutral, wherein the filterability of the base stock as measured by the Membrane Filtration Method is less than or equal to 400 seconds.

10. The oil of claim 9, wherein the heavy neutral ranges from 1 to 3 wt. % of the lubricating oil, and wherein the effective amount of one or more lubricant additives ranges from 0.2 to 20 wt. % of the lubricating oil.

11. The oil of claim 9, wherein the one or more lubricant additives are selected from the group consisting of antioxidants, stabilizers, detergents, dispersants, demulsifiers, antioxidants, anti-wear additives, pour point depressants, viscosity index modifiers, friction modifiers, anti-foam additives, defoaming agents, corrosion inhibitors, wetting agents, rust inhibitors, copper passivators, metal deactivators, extreme pressure additives, and combinations thereof.

12. A method of improving the filterability of a lubricant base stock comprising providing a bright stock and a heavy neutral, and adding 0.5 to 5 wt. % of the heavy neutral to the bright stock, wherein the filterability of the base stock as measured by the Membrane Filtration Method is less than or equal to 400 seconds.

13. The method of claim 12, wherein the heavy neutral ranges from 1 to 3 wt. % of the base stock.

14. The method of claim 12, wherein the filterability of the base stock as measured by the Membrane Filtration Method is less than or equal to 200 seconds.

15. The method of claim 12, wherein the base stock has a kinematic viscosity at 100° C. ranging from 20 to 40 cSt.

16. The method of claim 15, wherein the filterability increases less than 100 seconds over a time frame of 4-weeks when stored at room temperature.

* * * * *